United States Patent [19]

Hochbein et al.

[11] Patent Number: 5,058,878

[45] Date of Patent: Oct. 22, 1991

[54] CASSETTE STRUCTURE

[75] Inventors: David E. Hochbein, Sarver, Pa.; Ronald F. Pastuszak, Skillman, N.J.

[73] Assignee: Aluminum Company of America, Pittsburgh, Pa.

[21] Appl. No.: 450,476

[22] Filed: Dec. 14, 1989

[51] Int. Cl.[5] ..... B65H 1/00

[52] U.S. Cl. ..... 271/145; 271/162; 271/163

[58] Field of Search ..... 271/145, 163, 171, 107, 271/207, 223, 162, 9, 241; 221/211, 285; 211/41, 49.1; 414/930, 900, 795.4, 795.7, 796.5, 797, 797.1, 789.6

[56] References Cited

U.S. PATENT DOCUMENTS 1,940,242 12/1933 Burgess ..... 211/49.1
2,570,994 10/1951 Vaughan, Jr. et al. ..... 271/223
4,185,814 1/1980 Buchmann et al. ..... 271/108
4,787,533 11/1988 Haroutel et al. ..... 271/107

*Primary Examiner*—David H. Bollinger
*Attorney, Agent, or Firm*—Elroy Strickland

[57] ABSTRACT

An inclined cassette for holding and indexing a stack of planar items. The cassette includes a floor that is inclined at an angle sufficient to overcome the coefficient of friction of the planar items such that they slide to the lowermost corner of the floor. Two upstanding wall portions intersect each other at the lowermost corner to align the cards in a vertical stack, i.e., in a stack at an angle to the vertical. An elongated opening is provided in the wall portions at the corner, which opening extends upwardly from the location of the floor. The cassette further includes a base means for supporting the cassette in the inclined manner and in a manner that precisely locates the cassette for repeatable automatic removal of the planar items from the cassette.

2 Claims, 2 Drawing Sheets

CASSETTE STRUCTURE

BACKGROUND OF THE INVENTION

The present invention relates generally to a cassette structure for holding and indexing flexible, fragile planar items in a corner of the structure, and for accurately locating the structure in position for removing, one by one, the planar items.

In pending U.S. application Ser. No. 386,622, filed July 31, 1989 by David Hochbein, one of the inventors of the present application, an end effector device is disclosed for vacuum removal of interleaved articles disposed in a vertical stack, or at an angle to the vertical, and for separating and transporting the articles to separate locations. As stated in the application, the invention has particular utility for sequentially separating green ceramic cards from sheets of paper separating the cards from each other.

The disclosure of U.S. application Ser. No. 386,622 is incorporated herein by reference.

As explained further in the above application, it is preferred that cassettes employed for receiving and holding the cards and paper separators be inclined so that the cards will be "indexed" in a lower corner of the cassette. The cards and paper separators must be aligned so that the vacuum device (end effector), which is controlled and programmed to return to the same location each time for the removal operation, which location is the location of the cassette, will in fact properly engage each card and paper separator. It can be appreciated that if the cards and separators are not aligned, and otherwise properly and accurately located, the end effector cannot do its job of sequentially removing the cards and separators, and transporting them to their respective locations.

SUMMARY OF THE INVENTION

Proper location of flexible planar items for handling by an end effector is provided in the present invention by the use of an inclined cassette floor in combination with an elongated opening provided in a lower corner of the cassette formed by two intersecting walls. The angle of the incline is such that the coefficient of friction of the planar items is overcome to allow each item to slide to the lower end opening when the items are loaded into the cassette. The walls and incline, i.e., the force of gravity, align the items in the cassette, and the opening allows any particulate or foreign matter on the planar items, as they are loaded into or are removed from the cassette, to leave and fall from the cassette so that the items remain clean and uncontaminated in the cassette. If any of the planar items have not fully entered the corner, the operator can view the corners of the items and take steps to move the items into the corner so that they will be properly located before the end effector arrives to remove the items.

In a similar manner, each cassette placed in position for removal of the planar items therein by the end effector must itself be properly located, as the end effector "knows" only to travel and return to one location, i.e., the end effector has no ability to search for cassettes that are not at the location known by the apparatus that controls the end effector. Hence, if, for whatever reason, the cassette is not at the same location as all previous cassettes, the end effector will not be able to find the cassette and will thus not be able to sequentially remove the planar items from the cassette.

This problem is solved first by providing identical cassette structures, and then providing the legs or walls of a base of the cassette, which base supports the cassette floor and walls in the inclined manner, with slots positioned to receive locating pins that are always correctly located in relation to the end effector. Hence, when each cassette is disposed in place for the removal operation, the locater pins will engage the legs or walls of the cassette base at the locations of the slots such that each cassette, all of which are identical, will always be correctly located beneath the end effector when it arrives under instructions from a computer, for example, to travel to the location of the cassette and begin sequential removal of the planar items.

The identical cassette structures are provided by a repeating manufacturing process that produces and reproduces identical items. An injection molding process is suitable in this regard, as the mold employed in the process, when filled with moldable material, repeatably produces a cassette identical to the previous one.

THE DRAWINGS

The invention, along with objectives and advantages, will be best understood from consideration of the following detailed description and the accompanying drawings of which:

PREFERRED EMBODIMENTS

Figure 1:
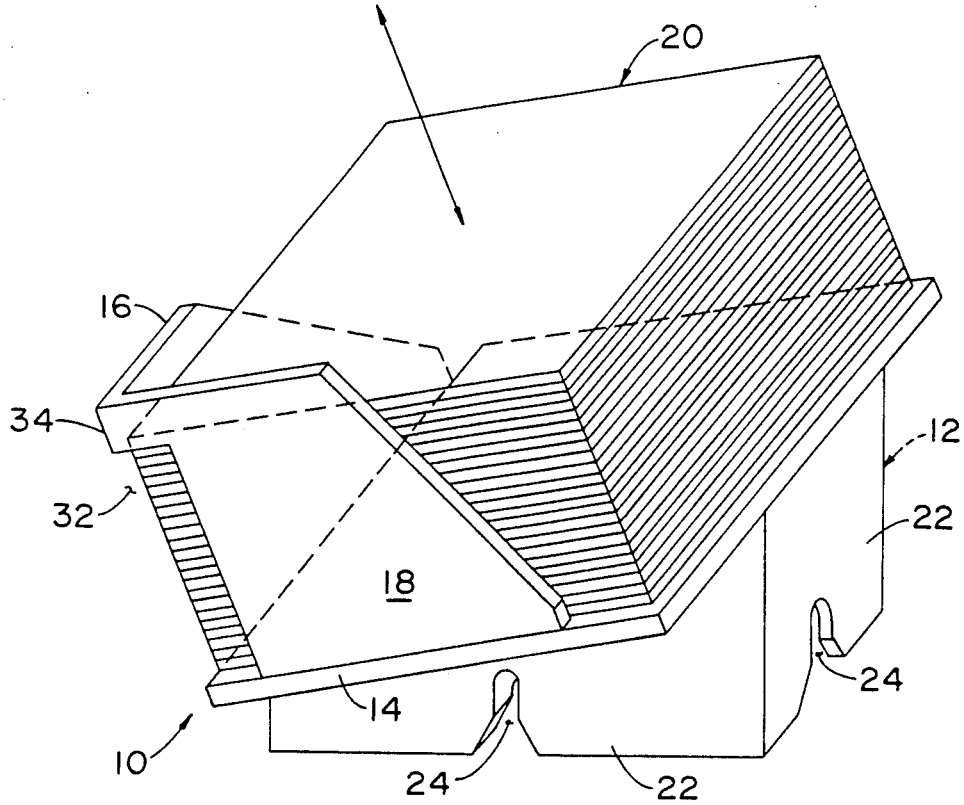
FIG. 1 is a perspective view of the cassette structure of the invention, with planar members being indexed and visible in a lower corner of the structure.

Referring now to FIG. 1 of the drawings, a cassette structure 10 is shown in perspective, the structure being comprised of a base 12 that supports a floor 14 of the structure at an angle inclined from the vertical. Two intersecting wall portions 16 and 18 are located at a lower corner of the floor for receiving, in an inclined manner, a stack of planar items 20.

Figure 2:
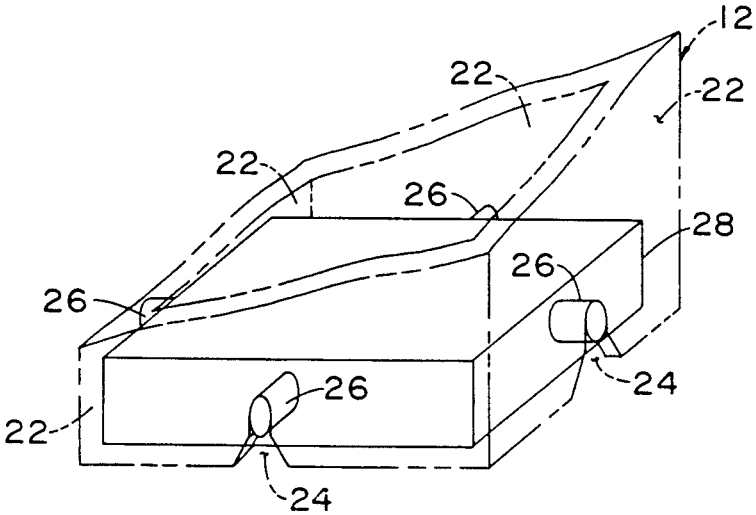
FIG. 2 is a phantom view of the base of the cassette structure showing a locater block and four pins.

As depicted in FIG. 1, base 12 comprises four walls 22, only two of which are visible (The view of the base in FIG. 2 provides a phantom view of all four walls). As shown in FIGS. 1 and 2, the lower edge of each wall is provided with a slot or opening 24, which opening receives a respective pin 26 (FIG. 2). The pins extend outwardly from the respective sides of a supporting box-like structure 28. As seen in the figures, the openings can be configured with a wide mouth and a narrow upper portion sized to fit the diameter of the pins without substantial play between the two. The wide mouth allows the base walls to easily find their respective pin, and guide the same to the narrow pin-fitting portion of the slot.

Figure 3:
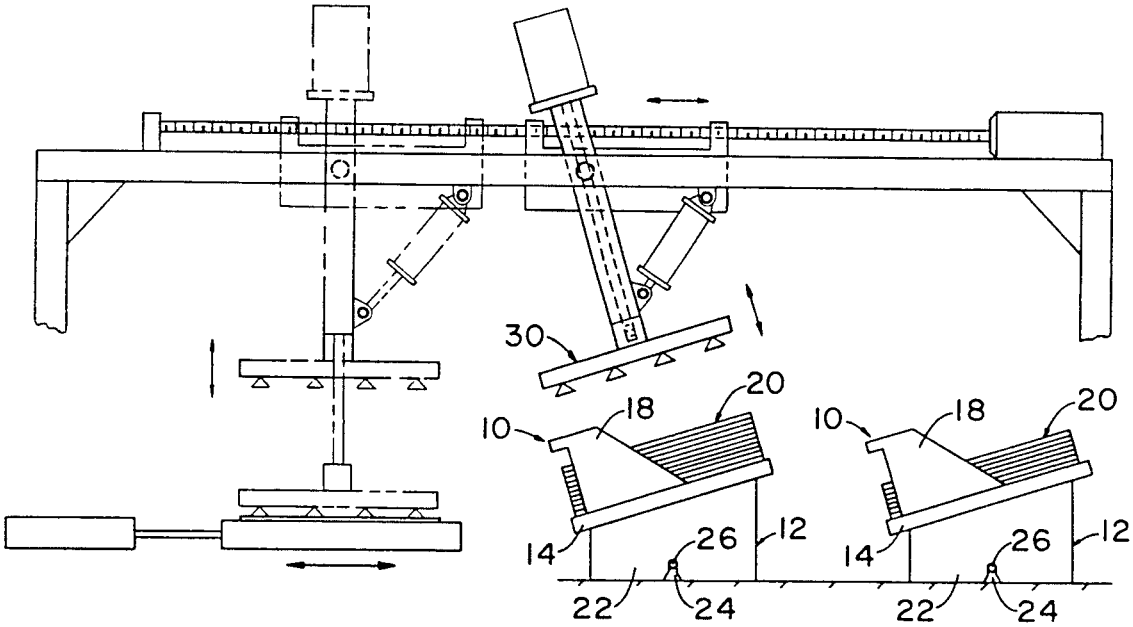
FIG. 3 shows an operation in which an end effector removes planar items from the cassette structure of FIGS. 1 and 2.

The cassette of the present invention is particularly useful with an end effector 30 that removes planar items from the stack of items on a one-by-one basis. The end effector is translated under programmed conditions to a known location, i.e., the location of stack 20, to remove the uppermost item from the stack each time it arrives at the stack and translates the same to another location. Such an operation is described in the above noted Hochbein application, and FIG. 3 of the present drawings shows mechanically the operation. The end effector is thus programmed to always return to the location of the stack and cassette, which location is known to a computer which controls the end effector. For this reason, when a full cassette is disposed in place to be emptied by the end effector, the cassette must be in the location known to the computer. The locations of box 28 and pins 26 are thus fixed, i.e., the box and pins are located in the fixed position relative to the end effector, and the base of all the cassettes used in the process are consistently constructed with slots 24, as discussed above, so that the end effector will, in fact, find each cassette for the emptying process when the computer orders the end effector to the location of the cassette.

For the same reasons, the planar items in stack 20 must be properly indexed in cassette 10. To this end, floor 14 and walls 16 and 18 are inclined at an angle that is greater than coefficient of friction of the items such that they slide to the lowermost corner of the floor under force of gravity when the items are loaded into the cassette. This corner intersects with the intersecting side walls 16 and 18. If the items are not aligned with each other to form an even, consistent stack, end effector 30 may not be able to properly engage items 20 to do its job of removing the items. Proper indexing of the items is particularly important if they are the green ceramic cards discussed in the above Hochbein application.

As discussed in the above cited Hochbein application, if the planar items include ceramic cards, adjacent cards are separated by smooth paper inserts having the same breadth as the cards. In this manner, the cards cannot contaminate each other and the "singulation process" disclosed in the application is aided.

Further, to insure that any particulate or other foreign matter that may be on planar items 20 have an opportunity to leave the items and cassette 10, an elongated opening 32 is provided at the intersecting location of walls 16 and 18. This is highly important when the planar items are ceramic cards used to make substrates for supporting solid state electronic components. Such cards are required to clean.

Opening 32 also allows items 20 to be visible to a workman-operator. If the items have not fully entered the corner of 32 when the items are placed in the cassette, the operator can take steps to move the items fully into the corner before end effector 30 arrives to remove the uppermost item from the stack.

Opening 32 is easily provided by simply providing an elongated slot in the edges of walls 16 and 18 that intersect to form the indexing corner. The two slots should extend from the location of floor 14 of the cassette to an upper location 34 where the walls join each other to provide a cassette structure of some integrity, i.e., only two walls (16 and 18) are preferred, as it leaves a somewhat "open" cassette for easy loading of planar items into the cassette.

The cassette of the invention can be made from any number of materials. A preferred material is plastic, as plastic materials are light in weight and provide an economical way to manufacture identical cassettes, such as by the injection molding process discussed earlier. In such a process, the entire structure of 10 is made by one operation, including the openings 24 provided in the base walls of the structure.

While the invention has been described in terms of preferred embodiments, the claims appended hereto are intended to encompass all embodiments which fall within the spirit of the invention.

What is claimed is:

1. An inclined cassette for holding and indexing a stack of planar items at a known, repeatable datum location and coordinates in space so that a blind end-effector can repeatably find said planar items, said cassette comprising:

base means for supporting the cassette in an inclined manner, a floor supported on said base means in said inclined manner, at least two upstanding wall portions intersecting each other at a lower corner of the inclined floor, an elongated opening provided at the location of intersection of the wall portions, said opening extending upwardly from the location of the floor at the lower corner thereof, said opening in combination with the incline of the cassette permitting foreign material in the cassette or on the planar items to leave the cassette through said opening, and said base means including four walls located beneath the inclined floor, with each of said walls having slotted openings for receiving pins that accurately position the cassette.

2. The apparatus of claim 1 wherein the items are green cermaic cards and paper sheets disposed in the cassette in an alternating manner such that a single stack of the cards and sheets is formed in which each two adjacent cards is separated by a paper sheet.

* * * * *